US006498908B2

(12) United States Patent
Phillips et al.

(10) Patent No.: US 6,498,908 B2
(45) Date of Patent: Dec. 24, 2002

(54) ELECTROPHOTOGRAPHIC MEASUREMENT SYSTEM

(75) Inventors: Quintin T. Phillips, Boise, ID (US); Matthew P. Daum, Eagle, ID (US)

(73) Assignee: Hewlett-Packard Company, Palo Alto, CA (US)

( * ) Notice: Subject to any disclaimer, the term of this patent is extended or adjusted under 35 U.S.C. 154(b) by 11 days.

(21) Appl. No.: 09/790,195

(22) Filed: Feb. 20, 2001

(65) Prior Publication Data

US 2002/0114636 A1 Aug. 22, 2002

(51) Int. Cl.[7] ..... G03G 15/00

(52) U.S. Cl. ..... 399/48; 399/46; 399/55; 399/56

(58) Field of Search ..... 324/452, 456; 399/38, 46, 48, 49, 50, 53, 55, 56, 66, 76, 159

(56) References Cited

U.S. PATENT DOCUMENTS 5,703,487 A * 12/1997 Mishra ..... 324/456
5,893,659 A * 4/1999 Nanjo et al. ..... 399/48

* cited by examiner

*Primary Examiner*—Hoang Ngo

(57) ABSTRACT

A first embodiment of a measurement system provides an indication of performance of an electrophotographic process. The first embodiment includes a charge measurement device coupled to a developing device and a high voltage power supply. The charge measurement device generates a signal corresponding to the net charge transferred between the high voltage power supply and the developing device during an imaging operation. The measured charge transfer is compared to an estimated charge transfer to determine if the electrophotographic process is operating correctly. The estimated charge transfer is determined by multiplying an estimate of the mass of the toner transferred during an imaging operation by an average value of toner charge to mass ratio. A sufficiently large difference in the magnitude between the measured charge transfer and the estimated charge transferred indicates that the electrophotographic process is not operating correctly. A second embodiment of measurement system includes a charge measurement device coupled to a photoconductor to measure the net charge transfer between the photoconductor and ground during an imaging operation. The net charge transfer is compared to the estimated charge transfer to determine whether the electrophotographic process is operating correctly. A third embodiment of the measurement system includes a voltage measuring probe to measure a voltage on the surface of a photoconductor. A controller determines if the measured surface voltage on the photoconductor is within a range of voltages occurring during normal operation of the electrophotographic process.

27 Claims, 4 Drawing Sheets

ELECTROPHOTOGRAPHIC MEASUREMENT SYSTEM

FIELD OF THE INVENTION

This invention relates to electrophotography. More particularly, this invention relates to the measurement of parameters related to the performance of the electrophotographic process.

BACKGROUND OF THE INVENTION

Electrophotography involves the controlled movement of colorant material, such as toner particles, under the influence of an electric field to create images, such as text, graphics, or pictures, on media. Overtime, the performance of the electrophotographic process can degrade as a result of the wear of components or depletion of materials used in the process. A need exists for a system that can detect changes in the electrophotographic process that may cause an unacceptable degradation in print quality.

SUMMARY OF THE INVENTION

Accordingly, a measurement system has been developed. The measurement system includes a developing device and a power supply coupled to the developing device. In addition, the measurement system includes a charge measuring device configured to measure charge transferred between the developing device and the power supply and to provide output related to measurement of the charge.

A measuring system includes a photoconductor. In addition, the measuring system includes a charge measuring device configured to measure charge flowing to or from the photoconductor and to provide output related to measurement of the charge.

A measuring system includes a photoconductor. In addition, the measuring system includes a voltage measurement device configured to measure voltage on the surface of the photoconductor and to provide output related to charge on the photoconductor. Furthermore, the measuring system includes a controller arranged to receive the output and configured to determine if a value of the output exists outside of a predetermined range.

A method for determining performance of an electrophotographic process includes determining a threshold value using an estimated quantity of toner for an imaging operation and a first value of a first parameter related to a characteristic of the toner. In addition, the method includes measuring a second value of a second parameter related to a flow of charge to or from a component in an electrophotographic system. Furthermore, the method includes determining the performance of the electrophotographic process using the second value and the threshold value.

An electrophotographic imaging device to form an image on media using toner includes a photoconductor and a photoconductor exposure system to form a latent electrostatic image on the photoconductor. In addition, the electrophotographic imaging device includes a developing device to develop the toner onto the media, a transfer device to transfer the toner from the photoconductor to the media, a fixing device to fix toner to the media, and a power supply configured to provide a bias to the developing device. Furthermore, the electrophotographic imaging device includes a charge measuring device configured to measure charge transferred between the developing device and the power supply and to provide output related to measurement of the charge and a controller arranged to receive the output and configured to compare a value of the output to a threshold value.

An electrophotographic imaging device to form an image on media using toner includes a photoconductor and a photoconductor exposure device to form a latent electrostatic image on the photoconductor. In addition, the electrophotographic imaging device includes a developing device to develop the toner onto the media, a transfer device to transfer the toner from the photoconductor to the media, and a fixing device to fix toner to the media. Furthermore, the electrophotographic imaging device includes a charge measuring device configured to measure charge flowing to or from the photoconductor to provide output related to measurement of the charge and a controller arranged to receive the output and configured to compare a value of the output to a threshold value.

A method for determining performance of an electrophotographic process includes measuring a distribution of charge flowing to or from a component in an electrophotographic system from a plurality of imaging operations and determining a threshold value using the distribution. In addition, the method includes measuring a value of a parameter related to the charge flowing to or from the component during an imaging operation following the plurality of imaging operations and determining the performance of the electrophotographic process using the value and the threshold value.

DESCRIPTION OF THE DRAWINGS

A more thorough understanding of embodiments of the measurement system may be had from the consideration of the following detailed description taken in conjunction with the accompanying drawings in which.

DETAILED DESCRIPTION OF THE DRAWINGS

Although embodiments of the parameter measuring system will be discussed in the context of an electrophotographic imaging device, such as a printer, it should be recognized that embodiments of the parameter measuring system can be usefully applied to a variety of other electrophotographic imaging devices, such as copiers, facsimile machines, and the like. Furthermore, although embodiments of the parameter measuring system will be discussed in the context of a monochrome electrophotographic imaging device, it should be recognized that embodiments of the parameter measuring system could be usefully applied in color electrophotographic imaging devices.

Figure 1:
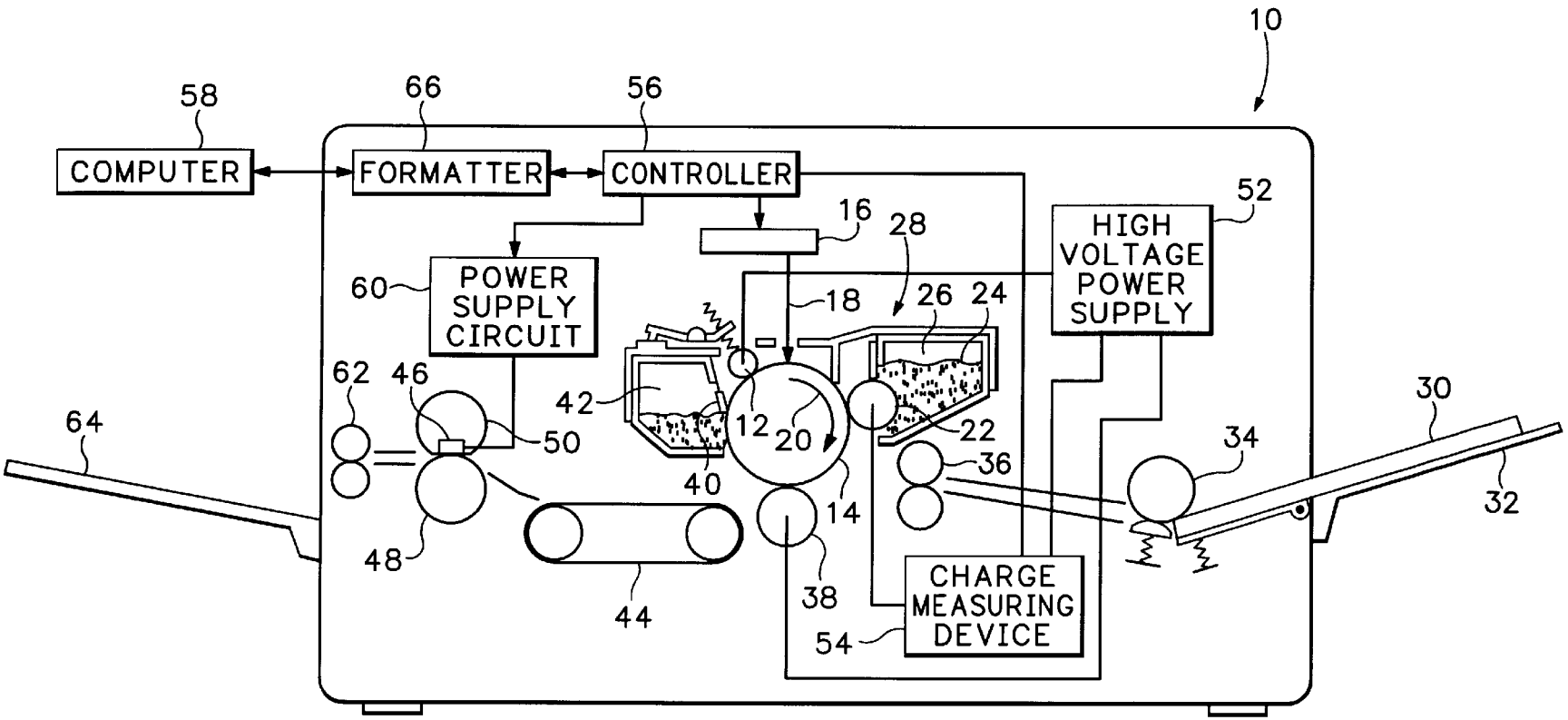
FIG. 1 shows a simplified diagram of an electrophotographic printer including a first embodiment of the measurement system.

Referring to FIG. 1, shown is a simplified cross sectional view of an embodiment of an electrophotographic imaging device, electrophotographic printer 10, including a first embodiment of the parameter measuring system. A charging device, such as charge roller 12, is used to charge the surface of a photoconductor, such as photoconductor drum 14, to a predetermined voltage. A laser diode (not shown) inside laser scanner 16 emits a laser beam 18 which is pulsed on and off as it is swept across the surface of photoconductor drum 14 to selectively discharge the surface of the photoconductor drum 14. Photoconductor drum 14 rotates in the clockwise direction as shown by the arrow 20. A developing device, such as developing roller 22, is used to develop the latent electrostatic image residing on the surface of photoconductor drum 14 after the surface voltage of the photoconductor drum 14 has been selectively discharged. Toner 24, which is stored in the toner reservoir 26 of electrophotographic print cartridge 28, moves from locations within the toner reservoir 26 to the developing roller 22. A magnet located within the developing roller 22 magnetically attracts toner 24 to the surface of the developing roller 22. As the developing roller 22 rotates in the counterclockwise direction, the toner 24, located on the surface of the developing roller 22 opposite the areas on the surface of photoconductor drum 14 which are discharged, can be moved across the gap between the surface of the photoconductor drum 14 and the surface of the developing roller 22 to develop the latent electrostatic image.

Media, such as print media 30, is loaded from paper tray 32 by pickup roller 34 into the media path of the electrophotographic printer 10. Print media 30 is moved along the media path by drive rollers 36. Print media 30 moves through the drive rollers 36 so that the arrival of the leading edge of print media 30 below photoconductor drum 14 is synchronized with the rotation of the region on the surface of photoconductor drum 14 having a latent electrostatic image corresponding to the leading edge of print media 30.

As the photoconductor drum 14 continues to rotate in the clockwise direction, the surface of the photoconductor drum 14, having toner adhered to it in the discharged areas, contacts the print media 30 which has been charged by a transfer device, such as transfer roller 38, so that it attracts particles of toner 24 away from the surface of the photoconductor drum 14 and onto the surface of the print media 30. The transfer of particles of toner 24 from the surface of photoconductor drum 14 to the surface of the print media 30 is not fully efficient and therefore some toner particles remain on the surface of photoconductor drum 14. As photoconductor drum 14 continues to rotate, toner particles, which remain adhered to its surface, are removed by cleaning blade 40 and deposited in toner waste hopper 42.

As the print media 30 moves in the paper path past photoconductor drum 14, conveyer 44 delivers the print media 30 to an embodiment of a fixing device, such as fuser 46. Fuser 46 is an instant on type fuser that includes a resistive heating element located on a substrate. Print media 30 passes between pressure roller 48 and the sleeve 50 of fuser 46. Pressure roller 48 is coupled to a gear train (not shown in FIG. 1) in electrophotographic printer 10. Print media 30 passing between pressure roller 48 and fuser 46 is forced against sleeve 50 of fuser 46 by pressure roller 48. As pressure roller 48 rotates, sleeve 50 is rotated and print media 30 is pulled between sleeve 50 and pressure roller 48. Heat applied to print media 30 by fuser 46 fixes toner 24 to the surface of print media 30.

An embodiment of a power supply, such as high voltage power supply 52, supplies the necessary voltages and currents to the components of electrophotographic printer 10 the electrophotographic imaging process. The components supplied by power supply 52 include charge roller 12, developing roller 22, and transfer roller 38. In some implementations of electrophotographic imaging devices, during the time period in which power is supplied to the components, charge roller 12 is supplied with a time varying signal having a DC offset, transfer roller 38 is supplied with a substantially constant current source, and developing roller 22 is supplied with a DC voltage having a superimposed time varying voltage.

An embodiment of a charge measuring device, charge measuring device 54, measures the charge flowing into developing roller 22. The output from charge measuring device 54 is coupled to an embodiment of a controller, controller 56. Controller 56 generates the necessary control signals at the proper time to control the development of an image on media 30 using the electrophotographic system included within electrophotographic printer 10. Controller 56 uses the output received from charge measuring device 54, along with information related to the number of pixels of the image on which toner will be placed, to determine if the electrophotographic process is operating correctly. If the process is not operating correctly, controller 56 generates a signal used by computer 58 to provide a warning to the user relating to the operation of the electrophotographic process.

Controller 56 is coupled to an embodiment of a power control circuit, power control circuit 60. Power control circuit 60 controls the electric power supplied to fuser 46, thereby controlling the operating temperature of fuser 46. Power control circuit 60 controls the average electrical power supplied to fuser 46. Power control circuit 60 adjusts the number of cycles of the line voltage per unit time applied to fuser 46 to control the average power supplied to fuser 46. After exiting fuser 46, output rollers 62 push the print media 30 into the output tray 64.

The embodiment of the electrophotographic imaging device shown in FIG. 1, electrophotographic printer 10, includes formatter 66. Formatter 66 receives print data, such as a display list, vector graphics, or raster print data, from the print driver operating in conjunction with an application program in computer 58. Formatter 66 converts this relatively high level print data into a stream of binary print data. Formatter 66 sends the stream of binary print data to controller 56. In addition, formatter 66 and controller 56 exchange data necessary for controlling the electrophotographic printing process. It should be recognized that in alternative embodiments of an electrophotographic imaging device, the functions performed by a formatter could be incorporated into a controller or the functions performed by the controller could be incorporated into the formatter.

Controller 56 supplies the stream of binary print data to laser scanner 16. The binary print data stream sent to the laser diode in laser scanner 16 is used to pulse the laser diode to create the latent electrostatic image on photoconductor drum 14. In addition to providing the binary print data stream to laser scanner 16, controller 56 controls a drive motor (not shown in FIG. 1) that provides power to the printer gear train and controller 56 controls the various clutches and paper feed rollers necessary to move print media 30 through the media path of electrophotographic printer 10.

Figure 2:
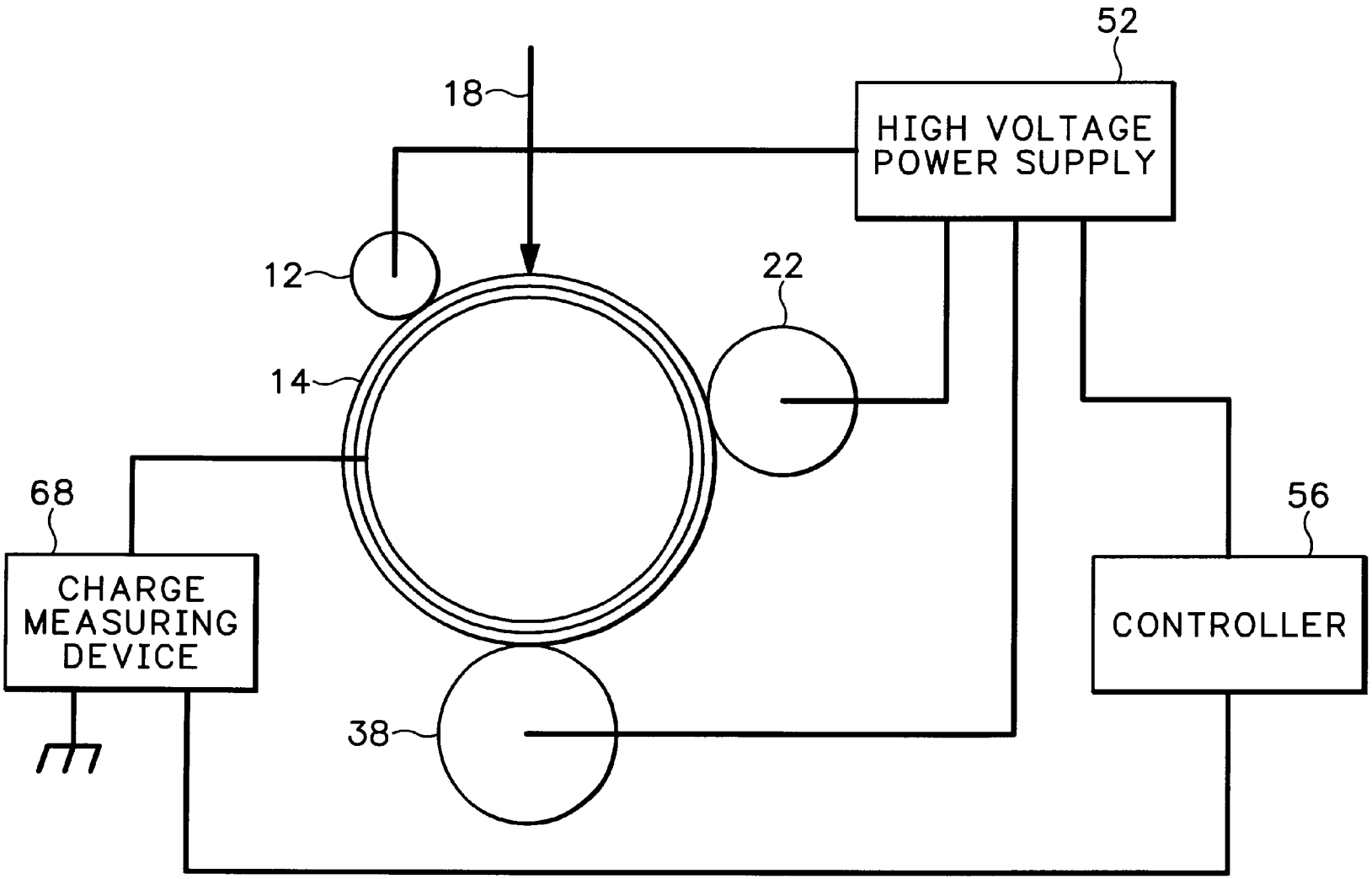
FIG. 2 shows a simplified diagram of a second embodiment of the measurement system.

Shown in FIG. 2 is a second embodiment of a measurement system for use within an electrophotographic imaging device, such as electrophotographic printer 10. In this second embodiment of the measurement system, charge measuring device 68 measures the net amount of charge transferred between ground and photoconductor drum 14 during an electrophotographic imaging operation including exposure of photoconductor drum 14 development of toner 24 onto photoconductor drum 14. Alternatively, charge measuring device 68 could be configured to measure the charge transfer during a portion of an imaging operation, such as during exposure of photoconductor drum 14 or during the development of toner 24 onto photoconductor drum 14. The output of charge measuring device 68 is coupled to controller 56. Controller 56 uses the output received from charge measuring device 68, along with information related to the number of pixels of the image on which toner will be placed, to determine if the electrophotographic process is operating correctly. If the process is not operating correctly, controller 56 generates a signal used by computer 58 to provide a warning to the user relating to the operation of the electrophotographic process.

Figure 3:
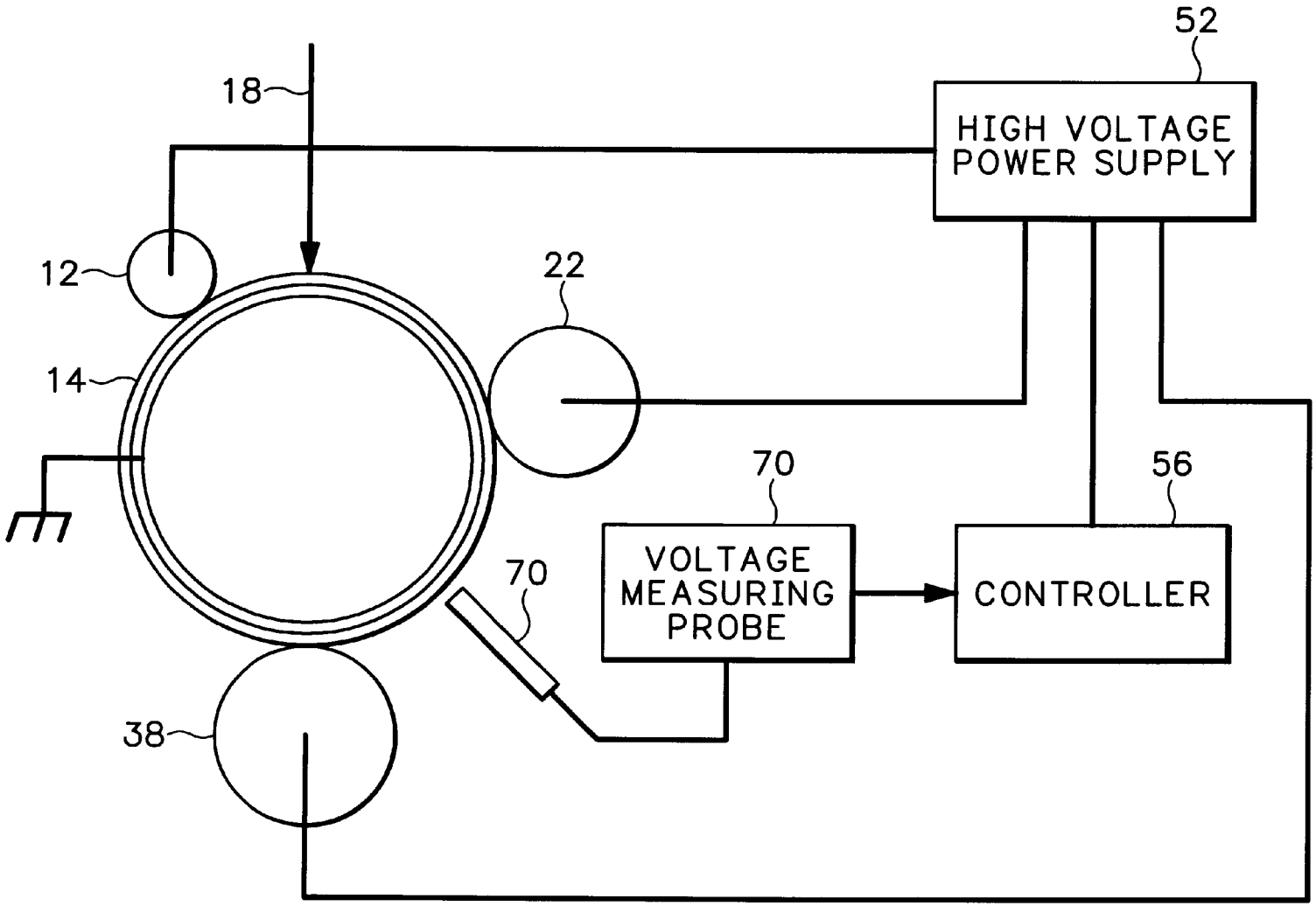
FIG. 3 shows a simplified diagram of the third embodiment of the measurement system.

Shown in FIG. 3 is a third embodiment of the measurement system for use within an electrophotographic imaging device, such as electrophotographic printer 10. A voltage measuring device, such as voltage measuring probe 70 measures the voltage of regions on the surface of photoconductor drum 14 after exposure to laser beam 18. The output of voltage measuring probe 70 is coupled to controller 56. Controller 56 uses the output received from electrostatic measuring probe 70 and stored data to determine if the electrophotographic process is operating correctly. If the process is not operating correctly, controller 56 generates a signal used by computer 58 to provide a warning to the user relating to the operation of the electrophotographic process.

Figure 4:
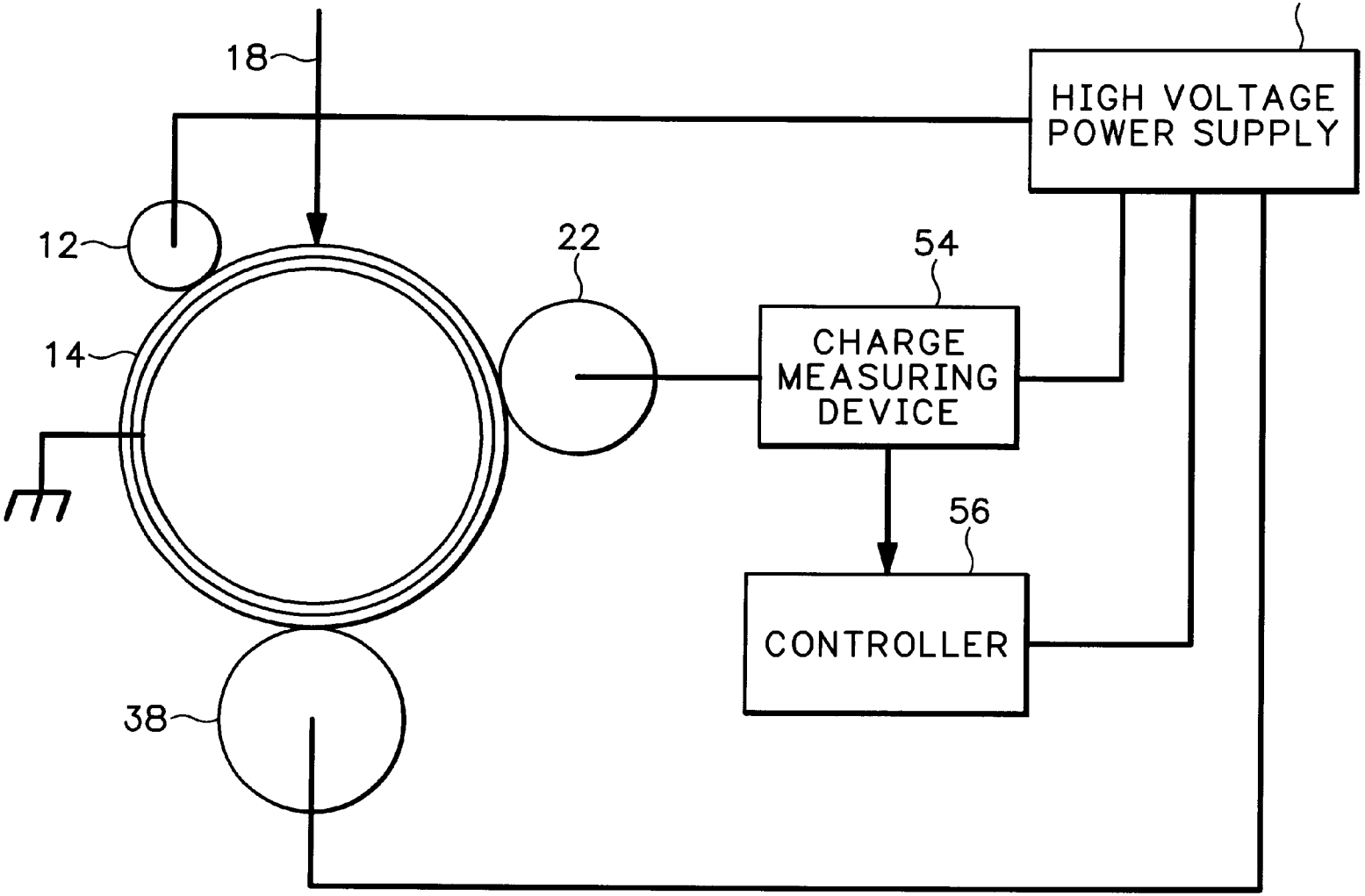
FIG. 4 shows a simplified diagram of a first embodiment of the measurement system.

Consider the first embodiment of the measurement system, shown in FIG. 4 in a simplified schematic representation. Charge measuring device 54 performs an integration of the net amount of charge flowing into developing roller 22 during the time that toner 24 is developed onto the latent electrostatic image on photoconductor drum 14. As developing roller 22 rotates, toner 24 contained within toner reservoir 26 develops a surface charge through tribo-electric charging. The charging comes about through the contact between toner particles and the sleeve of developing roller 22. In a dual component system using carrier beads, charging also results from the contact between toner particles and carrier beads. Materials are added to the toner to control the charge to mass ratio that develops on the toner particles as a result of the tribo-electric charging. In a mono-component system, iron oxide included within particles of toner 24 attracts particles of toner 24 to the surface of developing roller 22 under the influence of a magnetic field originating from a magnet within developing roller 22. In a dual component system, carrier beads include metal materials that are attracted to developing roller 22 and particles of toner 24 are electrostatically attracted to the carrier beads.

To move toner across the gap between developing roller 22 and photoconductor drum 14, a signal is applied to developing roller from high voltage power supply 52. The signal usually includes a time varying component imposed upon a substantially constant component. The applied signal projects toner adhered to developing roller 22 into the gap between developing roller 22 and the surface of photoconductor drum 14. The electric field in the gap is formed from the superposition of the electric field resulting from the signal applied to developing roller 22 and the charge on photoconductor drum 14. The strength of the electric field between the surface of developing roller 22 and the surface of photoconductor drum 14 can vary over the length of the gap as a result of the selective discharge of regions on the surface of photoconductor drum 14. The magnitude and polarity of the substantially constant component and the magnitude and frequency of the time varying component are selected to optimally deposit particles of toner 24 on the surface of photoconductor drum 14 in the regions selectively discharged by laser beam 18 and to substantially prevent the deposition of particles of toner 24 on the undischarged regions on the surface of photoconductor drum 14.

The particles of toner 24 transferred onto the surface of photoconductor drum 14 are generally charged to the same polarity with a distribution of charge mass ratios, although a relatively small percentage of the particles of toner 24 are charged to the wrong polarity. The polarity of the charges on the particles of toner 24 depend upon the specific electrophotographic process implemented. Regardless of the polarity of the charge on the toner particles, the movement of charged particles of toner 24 from developing roller 22 would result in a change of the charge balance of the toner 24 in toner reservoir 26 and developing roller 22 without the flow of charge into developing roller 22. The charge flowing into developing roller 22 compensates for the change in the charge balance that would result from the movement of charged particles of toner 24 from developing roller 22 onto the surface of photoconductor drum 14.

Charge measuring device 54 performs an integration of the charge flowing from power supply 52 into developing roller 22. As previously mentioned, the signal supplied to developing roller 22 by power supply 52 includes a time varying component and a substantially constant component. As a result, charge will move back and forth between developing roller 22 and power supply 52 as the magnitude of the applied signal changes. Because charge measuring device 54 performs an integration of the charge movement between power supply 52 and developing roller 22, charge measuring device 54 will provide, at any instant, an output related to the net charge either flowing to developing roller 22 from power supply 52 or from developing roller 22 to power supply 52.

The signal provided by charge measuring device 54 is coupled to controller 56. Controller 56 uses this signal to determine the effectiveness of the operation of the electrophotographic process in electrophotographic printer 10. Consider an imaging operation performed under the condition in which the volume of toner 24 contained in reservoir 26 is nearly depleted. Assume that the imaging operation will attempt to place toner on a relatively high percentage of the surface of a unit of print media 30. If adequate toner is not available within toner reservoir 26, then the imaging operation will not deposit an amount of toner 24 onto the unit of print media 30 that is adequate for the image. Because the amount of toner 24 transferred will be less than should have been transferred, the net charge flow between power supply 52 and developing roller 22 during the imaging operation will be less than it would have been had the correct amount of toner for the image been transferred to photoconductor drum 14.

Controller 56 includes a configuration to estimate the amount of toner 24 that should be deposited onto print media 30 for the imaging operation. In addition, controller 56 includes a configuration to estimate the amount of charge that would be transferred from developing roller 22 to photoconductor drum 14 during the imaging operation (and hence the net charge flow between power supply 52 and developing roller 22) using the estimate of the amount of toner 24. Controller 56 compares the amount of charge transfer measured by charge measuring device 54 to the estimate of the amount of charge that should have been transferred had the electrophotographic imaging process been operating correctly. If the amount of charge transferred is significantly greater or less than the estimate, then this is an indication that the electrophotographic process is likely not operating correctly.

Several different problems could cause a significant difference between the estimated charge transfer and the measured charge transfer. If toner 24 in toner reservoir 26 was sufficiently depleted, this could cause a significant difference. If for some reason, the toner charge/mass distribution was not within the normal operating range, this could result in a significant difference between the estimated and measured amounts of charge transferred. A toner charge/mass distribution that is outside of the normal range can cause inadequate development of the latent electrostatic image formed on photoconductor drum 14. A toner charge/mass distribution outside of the normal range of values could result from relatively extreme environmental details or problems in the formulation of the toner.

Another possible problem that could cause a significant difference between the estimated charge transferred and the measured charge transferred involves changes to photoconductor drum 14 that reduce its ability to adequately discharge after exposure to laser beam 18. Inadequate discharge of photoconductor drum 14 would result in less of toner 24 (and consequently less charge) transferred from developing roller 22 to the surface of photoconductor drum 14 than under conditions in which photoconductor drum 14 was operating normally. Yet another problem could result if photoconductor drum 14 lost the ability to effectively hold charge or had a lower than normal discharge voltage. In this case greater than normal amounts of toner 24 would be transferred (and consequently more charge). As a result, the amount of charge measured by charge measuring device 54 could significantly exceed the normal amount of charge transferred. An additional problem results if charge roller 12 does not adequately charge the surface of photoconductor drum 14, background development may occur with the formation of the image, causing a larger than normal amount of toner 24 to be transferred to the surface of photoconductor drum 14.

Determining whether a significant change in the charge transferred (as compared to the normal operation of the electrophotographic process) has occurred involves comparing the measured value of the charge transfer to an estimated value of the charge that would be transferred under normal operation of the electrophotographic process. If the magnitude of the value formed by the difference between the measurement of the charge transfer and the estimated charge transfer exceeds a predetermined value, then it is concluded that one or more aspects of the electrophotographic process are not operating normally.

Computation of the estimated charge transfer could be performed within formatter 66, controller 56, computer 58 or another computational device that might be included within electrophotographic printer 10. Computation of the estimated charge transfer includes a computation, from the data defining the images to be formed on units of media 30, of the number of pixels onto which particles of toner 24 will be placed. Using a value determined for the average mass of toner developed onto the surface of photoconductor drum 14 for developed pixels and a value determined for the average charge per unit mass of toner 24, the estimated charge transfer for an imaging operation is computed. The measured charge transfer, over the time for which the estimated charge transfer is computed, is related to the output provided by charge measuring device 54 to controller 56. Controller 56 determines the measured charge transfer using the output from charge measuring device 54. Determination of the measured charge transfer may be done computationally using the output from charge measuring device 54 or it may be done by accessing a lookup table based upon the range of values into which the measured charge transfer falls. The difference between the estimated charge transfer and the measured charge transfer provides an indication of the performance of the electrophotographic process.

The values for the average mass of toner developed onto the surface of photoconductor drum 14 for developed pixels and for the average charge per unit of mass of toner 24 could be derived analytically or empirically. However, because of the complexity involved in analytically determining the values with sufficient accuracy, it will likely be less difficult to arrive at these values using empirical techniques. The value for the average charge per unit mass of toner 24 could be determined empirically through analysis of samples of toner 24 under a variety of environmental conditions. Using the empirically determined value for the average charge per unit mass, the average mass of toner developed onto pixels could be empirically determined by measuring the charge transferred in a sufficiently large population of electrophotographic imaging devices of similar design as electrophotographic printer 10. Knowing the number of pixels developed that gave rise to the measured charge transfer, the measured charge transfer, and the average charge per unit mass of toner 24, a value for the average mass of toner per developed pixel can be computed for the population of printers having the same design as electrophotographic printer 10. Alternatively, controller 56 in electrophotographic printer 10 could be configured to collect charge measurement data from charge measuring device 54 over a period of time during which it is known that the electrophotographic process is operating correctly and, using the value determined for the average charge per unit mass, the measured charge transfer, and the number of developed pixels, determine the average mass of toner developed per pixel for a specific one of electrophotographic printer 10.

The data from the characterization of the electrophotographic process and the number of pixels onto which development of particles of toner 24 occurs, would be used to determine the expected normal range of the measured charge transfer during an imaging operation. From the normal expected range of charge transfer, controller 56 would determine the predetermined value as the maximum difference acceptable between the upper limit of the range of the measured charge transfer or the lower limit of the range of the measured charge transfer. It should be recognized that two predetermined values could be determined, one associated with the upper limit of the range and one associated with the lower limit of the range.

Another way in which the predetermined value could be derived involves the collection of measured charge transfer statistics for the electrophotographic printer 10 in which the predetermined value will be used. The measured charge transfer for electrophotographic printer 10 would be collected, beginning with the initial use of electrophotographic printer 10, over a period of time to establish a distribution of the measured charge transfer normalized to a per unit of media 30 basis. Absent any fault conditions occurring on electrophotographic printer 10, it will be assumed that the operation was normal over this period of time. Using the measured distribution of measured charge transfer, the predetermined value would be determined so that if the measured charge transfer resulting from a particular imaging operation exceeds the average of the distribution or falls below the average of the distribution by at least the predetermined value, then it is concluded that the electrophotographic process is not operating normally.

The predetermined value corresponds to a selected likelihood that the measured charge transfer for a particular imaging operation was generated from the electrophotographic process that resulted in the previously measured distribution of measured charge transfer. For example, the predetermined value could be selected so that only 0.1% of the measured charge transfer values coming from the normally operating electrophotographic process would be likely to yield measured charge transfer values that are above or below the average of the measured distribution by at least the predetermined value. It should be recognized that two predetermined values could be determined, one associated with the portion of the measured distribution above the average and one associated with the portion of the measured distribution below the average.

The second embodiment of the measurement system operates in a manner similar to the first embodiment. Charge measuring device 68 provides a measurement of the charge transfer during an imaging operation that can be used to determine whether the electrophotographic process is operating correctly. Consider the case in which charge roller 12 charges the surface of photoconductor drum 14 to a negative potential. The substrate of photoconductor drum 14 is typically formed of a conductive material such as aluminum and electrically coupled to ground. In response to the charging of the surface of photoconductor drum 14, an image charge forms on the aluminum substrate of photoconductor drum 14 opposite the polarity of the charge on the surface of photoconductor 14. Exposure of the charged surface of photoconductor drum 14 to laser beam 18 results in the neutralization of the some of the image charge. However, when toner 24 is developed onto the discharged regions of photoconductor drum 14, charge flows onto the substrate of photoconductor drum 14 to balance the charge added by toner 24. Charge measuring device 68 measures the net flow of the charge to or from photoconductor drum 14.

Consider the case in which a sufficient quantity of toner 24 for an imaging operation is not available within toner reservoir 26. For this situation, the quantity of toner 24 that would be developed onto photoconductor drum 14 for the imaging operation is less than it would have been for normal operation of the electrophotographic process. Consequently, the amount of charge flowing onto the substrate of photoconductor drum 14 is less than it would have been had the electrophotographic process been operating properly.

Consider the case in which photoconductor drum 14 either will not properly hold a charge provided by charge roller 12 or will not properly discharge after exposure to laser beam 18 (either insufficient discharge or excessive discharge). For this situation, the quantity of toner 24 that would be developed onto photoconductor drum 14 for the imaging operation would be different than it would have been for normal operation of the electrophotographic process. Consequently, the amount of charge flowing onto the substrate of photoconductor drum 14 is less than it would have been had the electrophotographic process been operating properly.

Consider the case in which toner 24 is either under charged or over charged. For this situation, the quantity of toner 24 that would be developed onto photoconductor drum 14 would be different than it would have been for normal operation of the electrophotographic process. Consequently, the amount of charge flowing onto the substrate of photoconductor drum 14 is less than it would have been had the electrophotographic process been operating properly.

For each of the previously mentioned situations, controller 56 determines the measured charge transfer from the output of charge measuring device 68. For the imaging operation, controller 56 determines an estimate of the charge transfer using an average value of charge per unit mass of toner 24, an average value of the mass of toner 24 developed per pixel, and the number of pixels to be developed in the imaging operation. The determination of the average value of the charge per unit of mass of toner 24, the average mass of toner 24 per developed pixel, and the number of pixels that will be developed in an imaging operation, are determined as described for the first embodiment of the parameter measurement apparatus.

Controller 56 determines if the magnitude of the difference between the measured charge transfer and the estimated charge transfer exceeds a predetermined value (or possibly values depending upon whether different predetermined values are used for the difference allowed above and below the estimated charge transfer). If the predetermined value is exceeded, then controller 56 generates a signal indicating that the electrophotographic process is not operating correctly.

The third embodiment of the measurement system measures the voltage on the surface of photoconductor drum 14 using voltage measuring probe 70 to detect problems in the electrophotographic process. For example if charge roller 12 improperly charges photoconductor drum 14 (either raising the magnitude of the potential of photoconductor drum 14 to high or not sufficiently high) the output from voltage measuring probe 70 will change correspondingly. Controller 56 monitors the output of electrostatic probe 70 and determines if the measured voltage on the surface of photoconductor drum 14 is within the allowable range. If the surface voltage is less than or greater than predetermined limits, controller 56 generates a signal indicating that the electrophotographic process is not operating properly.

Other problems with the electrophotographic process within electrophotographic printer 10 can result in a voltage on the surface of photoconductor drum 14 outside of the allowable limits. For example, if photoconductor drum 14 cannot adequately hold the charge provided by charge roller 12, then the voltage on the surface of photoconductor drum 14 may be outside of the normal range of the surface voltage on photoconductor drum 14. Another possible cause of a change in the voltage measured by voltage measuring probe 70 involves a change in the sensitivity of photoconductor drum to laser beam 18. The change in sensitivity may cause a decrease or an increase in the magnitude of the discharge voltage of photoconductor drum 14 resulting from exposure to laser beam 18. A change in the discharge voltage from the normal range affects the quantity of toner 24 developed onto photoconductor drum 14 and therefore can indicate that the electrophotographic process is not operating correctly.

Improperly charged toner can reduce the quantity of toner 24 developed onto the surface of photoconductor drum 14. Electrostatic probe 70 would detect this condition by measuring the voltage on the surface of photoconductor drum 14 over regions onto which toner 24 has been developed. If an insufficient quantity of toner 24 is developed onto the discharged regions of photoconductor drum 14, the surface voltage magnitude will be outside of the expected range of surface voltage. If the surface voltage is outside of the expected range of surface voltage, controller 56 generates a signal indicating that the electrophotographic process is not operating correctly.

Charge measuring device 54 and charge measuring device 68 could be implemented in a variety of ways. An important performance attribute of the various embodiments of charge measuring device 54 or charge measuring device 68 is the capability to provide output related to the measured charge. One way in which to measure the charge includes performing an integration of the current. Embodiments of either of the charge measuring devices could be implemented using an analog or digital integrator to integrate the current flowing, respectively, into the developing roller 22 or photoconductor drum 14 to measure the charge transferred during an imaging operation. The output of the integrator would be an analog signal or a digital value representing the net charge transferred during the period of time during which the integration was performed.

Embodiments of either of the charge measuring device 54 or charge measuring device 68 could be implemented using a non-contact current sensing probe to measure the currents flowing into either photoconductor drum 14 or developing roller 22. For example, a current sensing probe having performance attributes similar to a Tektronix CT1 current probe would have a measurement capability suitable for use in embodiments of charge measuring device 54 or charge measuring device 68. The output of the current probe corresponds to current amplitude and would be integrated over a period of time to determine the net charge transferred during an imaging operation. A non-contacting current probe would work particularly well in an embodiment of charge measuring device 54 because of its ability to measure currents in the presence of the large magnitude bias voltage supplied to developing roller 22.

A coulomb meter could be used for embodiments of charge measuring device 54 and charge measuring device 68. For charge measuring device 54, a coulomb meter would measure the net charge transfer between developing roller 22 and high voltage power supply 52 during an imaging operation. For charge measuring device 68, a coulomb meter would measure the net charge transfer between photoconductor drum 14 and ground during an imaging operation. A coulomb meter having performance attributes similar to that of a Trek Incorporated, model 217 coulomb meter would have a sensitivity suitable for measuring the net charge transfer between photoconductor 14 and ground.

Although embodiments of the measurement system have been illustrated, and described, it is readily apparent to those of ordinary skill in the art that various modifications may be made to these embodiments without departing from the scope of the appended claims.

What is claimed is:

1. A measurement system comprising:

a developing device;

a power supply coupled to the developing device; and a charge measuring device configured to measure a quantity of charge transferred between the developing device and the power supply and to provide output related to measurement of the quantity of the charge.

2. The measurement system as recited in claim 1, further comprising:

a controller arranged to receive the output and including a configuration to compare a value of the output to a threshold value.

3. The measurement system as recited in claim 2, wherein:

the controller includes a configuration to determine a distribution of the charge from a plurality of imaging operations using the output and to determine the threshold value using the distribution.

4. The measurement system as recited in claim 3, wherein:

the controller includes a configuration to determine an average of the distribution; and the controller includes a configuration to determine the threshold value including an upper threshold value greater than the average and a lower threshold value less than the average so that a predetermined fraction of the distribution lies between the upper threshold value and the lower threshold value.

5. The measurement system as recited in claim 2, wherein:

the controller includes a configuration to determine an estimated quantity of toner for an imaging operation and to determine the threshold value using a charge per unit mass of the toner and the estimated quantity of the toner.

6. The measurement system as recited in claim 5, wherein:

the charge measuring device includes an integrator to measure the charge transferred between the developing device and the power supply during the imaging operation.

7. The measurement system as recited in claim 6, wherein:

the charge measuring device includes a configuration to detect a magnetic field resulting from movement of the charge between the developing device and the power supply and to supply a signal related to the magnetic field to the integrator.

8. A measuring system, comprising:

a photoconductor;

a charge measuring device configured to measure a quantity of charge flowing to or from the photoconductor and to provide output related to measurement of the quantity of the charge; and a controller arranged to receive the output and including a configuration to compare a value of the output to a threshold value.

9. The measurement system as recited in claim 8, wherein:

the controller includes a configuration to determine a distribution of the charge from a plurality of imaging operations using the output and to determine the threshold value using the distribution.

10. The measurement system as recited in claim 9, wherein:

the controller includes a configuration to determine an average of the distribution; and the controller includes a configuration to determine the threshold value including an upper threshold value greater than the average and a lower threshold value less than the average so that a predetermined fraction of the distribution lies between the upper threshold value and the lower threshold value.

11. The measuring system as recited in claim 8, wherein:

the controller includes a configuration to determine an estimated quantity of toner for an imaging operation and to determine the threshold value using a charge per unit mass of the toner and the estimated quantity of the toner.

12. The measuring system as recited in claim 11, wherein:

the charge measuring device includes an integrator to measure the charge transferred to or from the photoconductor during the imaging operation.

13. A measuring system, comprising:

a photoconductor;

a voltage measurement device configured to measure voltage on the surface of the photoconductor after development of toner onto a latent electrostatic image and to provide output related to charge on the photoconductor; and a controller arranged to receive the output and configured to determine if a value of the output exists outside of a predetermined range.

14. The measuring system as recited in claim 13, wherein:

the predetermined range corresponds to a range of voltage occurring during operation of the electrophotographic process.

15. A method for determining performance of an electrophotographic process, comprising:

determining a threshold value using an estimated quantity of toner for an imaging operation and a first value of a first parameter related to a characteristic of the toner;

measuring a second value of a second parameter related to a flow of charge to or from a component in an electrophotographic system; and determining the performance of the electrophotographic process using the second value and the threshold value.

16. The method as recited in claim 15, wherein:

determining the performance of the electrophotographic process includes comparing the second value to the threshold value.

17. The method as recited in claim 16, wherein:

determining the threshold value includes determining the estimated quantity of the toner for the imaging operation using data defining an image.

18. The method as recited in claim 17, wherein:

the second parameter corresponds to a charge per unit mass of the toner; and determining the threshold value includes computing an estimated charge using a charge per unit mass of the toner and the estimated quantity of the toner.

19. The method as recited in claim 18, wherein:

determining the estimated quantity of the toner for the imaging operation includes computing a mass of the toner developed during the imaging operation using the data defining the image and a mass per unit area.

20. The method as recited in claim 17, wherein:

the second parameter corresponds to a charge per unit mass of the toner; and determining the threshold value includes accessing a memory, with the memory for storing data for a range of the charge associated with masses of the toner, using the estimated quantity of the toner.

21. The method as recited in claim 20, wherein:

determining the estimated quantity of the toner for the imaging operation includes computing a mass of the toner developed during the imaging operation using the data defining the image and a mass per unit area.

22. An electrophotographic imaging device to form an image on media using toner, comprising:

a photoconductor;

a photoconductor exposure system to form a latent electrostatic image on the photoconductor;

a developing device to develop the toner onto the media;

a transfer device to transfer the toner from the photoconductor to the media;

a fixing device to fix toner to the media;

a power supply configured to provide a bias to the developing device;

a charge measuring device configured to measure a quantity of charge transferred between the developing device and the power supply and to provide output related to measurement of the quantity of the charge; and a controller arranged to receive the output and configured to compare a value of the output to a threshold value.

23. The electrophotographic imaging device as recited in claim 22, wherein:

the controller includes a configuration to determine an estimated quantity of the toner for an imaging operation and to determine the threshold value using a charge per unit mass of the toner and the estimated quantity of the toner.

24. An electrophotographic imaging device to form an image on media using toner, comprising:

a photoconductor;

a photoconductor exposure device to form a latent electrostatic image on the photoconductor;

a developing device to develop the toner onto the media;

a transfer device to transfer the toner from the photoconductor to the media;

a fixing device to fix toner to the media;

a charge measuring device configured to measure a quantity of charge flowing to or from the photoconductor to provide output related to measurement of the quantity of the charge; and a controller arranged to receive the output and configured to compare a value of the output to a threshold value.

25. The electrophotographic imaging device as recited in claim 24, wherein:

the controller includes a configuration to determine an estimated quantity of the toner for an imaging operation and to determine the threshold value using a charge per unit mass of the toner and the estimated quantity of the toner.

26. A method for determining performance of an electrophotographic process, comprising:

measuring a distribution of charge flowing to or from a component in an electrophotographic system from a plurality of imaging operations;

determining a threshold value using the distribution;

measuring a value of a parameter related to the charge flowing to or from the component during an imaging operation following the plurality of imaging operations; and determining the performance of the electrophotographic process using the value and the threshold value.

27. The method as recited in claim 26, wherein:

measuring the distribution of the charge includes determining an average of the distribution;

determining the threshold value includes determining an upper threshold value greater than the average and a lower threshold value less than the average so that a predetermined fraction of the distribution lies between the upper threshold value and the lower threshold value; and determining the performance includes comparing the value to at least one of the upper threshold value and the lower threshold value.

* * * * *